US011744363B2

(12) United States Patent
Rozeboom et al.

(10) Patent No.: US 11,744,363 B2
(45) Date of Patent: Sep. 5, 2023

(54) FURNITURE WITH AIR FILTER SUPPORT

(71) Applicant: SPECIAL-T, LLC, Alpharetta, GA (US)

(72) Inventors: Stephen Rozeboom, Alpharetta, GA (US); Brandon Rayburn, Alpharetta, GA (US)

(73) Assignee: SPECIAL-T, LLC, Alpharetta, GA (US)

( * ) Notice: Subject to any disclaimer, the term of this patent is extended or adjusted under 35 U.S.C. 154(b) by 0 days.

(21) Appl. No.: 17/141,936

(22) Filed: Jan. 5, 2021

(65) Prior Publication Data

US 2021/0145171 A1 May 20, 2021

Related U.S. Application Data

(60) Provisional application No. 63/084,180, filed on Sep. 28, 2020, provisional application No. 63/080,087, filed on Sep. 18, 2020.

(51) Int. Cl.

| | |
|---|---|
| ***A47B 83/00*** | (2006.01) |
| ***F24F 3/163*** | (2021.01) |
| ***E04B 2/74*** | (2006.01) |

(52) U.S. Cl.

CPC ..... *A47B 83/001* (2013.01); *F24F 3/163* (2021.01); *E04B 2002/7483* (2013.01)

(58) Field of Classification Search

CPC ..... A47B 83/001; A47B 97/00; F24F 3/163; F24F 2221/10; F24F 8/10; F24F 2221/38; E04B 2002/7483

See application file for complete search history.

(56) References Cited

U.S. PATENT DOCUMENTS

| | | | | |
|---|---|---|---|---|
| 4,248,162 | A | 2/1981 | Skeist | |
| 4,625,633 | A | 12/1986 | Martin | |
| 4,784,445 | A * | 11/1988 | Ott | A47B 83/001 312/236 |
| 5,065,832 | A | 11/1991 | Mark | |
| 5,267,895 | A * | 12/1993 | Mitchell | F24F 3/163 454/57 |
| 6,053,588 | A | 4/2000 | Biggel et al. | |
| 6,797,042 | B2 | 9/2004 | LaFerrieri et al. | |
| 7,198,567 | B2 * | 4/2007 | Casey | B08B 15/002 454/49 |
| 9,050,382 | B2 | 6/2015 | Carr | |
| 9,579,597 | B2 | 2/2017 | Gruenbacher et al. | |

(Continued)

FOREIGN PATENT DOCUMENTS

| | | |
|---|---|---|
| CN | 203336716 U | 12/2013 |
| CN | 107091513 A | 8/2017 |

(Continued)

OTHER PUBLICATIONS

International Search Report and Written Opinion dated Apr. 1, 2021 on corresponding International Patent Application No. PCT/US2021/012216, 12 pages.

*Primary Examiner* — Brian D Mattei
*Assistant Examiner* — Omar F Hijaz
(74) *Attorney, Agent, or Firm* — POLSINELLI PC

(57) ABSTRACT

A furniture apparatus includes an integrated holder for supporting and securing an air filter system adjacent the furniture apparatus to filter air exhaled between persons at or near the furniture apparatus.

10 Claims, 22 Drawing Sheets

(56) References Cited

U.S. PATENT DOCUMENTS

| | | | | |
|---|---|---|---|---|
| 9,962,642 | B2 * | 5/2018 | Morison | B01D 46/02 |
| 10,684,027 | B2 | 6/2020 | Goswami et al. | |
| 2002/0078830 | A1 * | 6/2002 | Chung | B01D 46/46 96/424 |
| 2014/0363333 | A1 * | 12/2014 | Carr | A61L 9/03 422/123 |
| 2017/0318958 | A1 * | 11/2017 | Asante | A47B 19/06 |
| 2019/0041883 | A1 * | 2/2019 | Clark | F24F 11/30 |

FOREIGN PATENT DOCUMENTS

| | | | | |
|---|---|---|---|---|
| EP | 3711842 | A1 * | 9/2020 | B01D 46/0004 |
| WO | WO2020028117 | A1 | 2/2020 | |

* cited by examiner

FURNITURE WITH AIR FILTER SUPPORT

CROSS-REFERENCE TO RELATED APPLICATIONS

This application claims the benefit of priority of provisional application No. 63/084,180 filed Sep. 28, 2020 and provisional application No. 63/080,087 filed Sep. 18, 2020, all of which are incorporated herein by reference.

BACKGROUND OF THE INVENTION

The present invention relates to furniture that supports air purifiers for filtering and destroying pathogens, contagions, pollutants, bacteria, viruses, mold, microbes, allergens, smoke, and the like. Typical air purifiers and filter systems are integrated into conventional heating, ventilation and air conditioning (HVAC) systems or may be wall-mounted or stand-alone on floors and furniture in total room-treating environments. These existing air purifier and filter systems do not account for or optimize air purification and filtering among the relative position of multiple persons in a room and air height levels where such persons are exhaling pathogens and the like into the surrounding air that could be breathed in by nearby persons. Accordingly, there is a need for an air filtering system and air purification system wherein the air filter system providing suction and airflow into the system is positioned approximately at head and mouth level of multiple persons relative to seating or standing positions, such as above the chest in the expected positions of the persons, so as to provided improved, and preferably optimal, drawing of exhaled air from the persons into the air filtration system.

SUMMARY OF THE INVENTION

In one embodiment of the invention, an air filtration system (including air purification systems) is elevated on a supporting structure, including on or in an integrated furniture holder, pedestals, columns, post, pedestal, attachment to ceilings or walls with extension to the desired elevation level, and like filter elevating structures, above the chests of multiple users, and even more preferably at head and mouth levels, in a targeted space for air filtration. Preferably the elevation level accounts for whether the nearby persons will be seated or standing and if such persons are adults or children. In various embodiments the elevation support for air filter is height adjustable for optimizing the positioning for collecting exhaled air into the elevated air filtration system. It will be appreciated that the air filter system may be secured at the desired height by numerous means to the elevated support structure, including without limitation brackets, adhesives, clips, holders, customized recesses seating the air filter while allowing airflow into and out of the system, coupling hardware, grips, ties and the like. In various embodiments the air filtration system may include different filter technologies as desired for the elements to be filtered from the air, including without limitation "Photo Electrochemical Oxidation" (PECO), "High Efficiency Particulate Air" or "High Efficiency Particulate Arrestance" (HEPA), polyester and pleated filters, washable filters, and the like. Throughout this specification, embodiments of the invention use air purification systems available from Surgically Clean Air (Toronto, Canada) to preferably capture exhaled air pathogens and output clean air; however, the invention will be appreciated as not limited by particular types of filters.

In one embodiment, an elevated filter system is provided in a central position in a workstation accommodating two or more persons, i.e., multiple persons. The workstation includes integrated divider panels between personal work areas of the work table/surface so as to minimize exhaled air contacting adjacent person using the workstation. An elevated support, such as a raised platform where the dividers meet couples to (such as with brackets) or holds the air filtration system at centralized position between the users at about the middle of the work surface and at an approximate mouth height (above the chest) of the workstation users. The elevated support is preferably integrated in the workstation with the divider panels and work surface. In preferred embodiments, the dividers have essentially air tight seals with the work surface of the workstation and are also sealed relative to the junction at the elevated support for the air filtration system. The sealing of dividers together with the suctioning of air into the air filtration system from the air filtration fan/motor promotes exhaled air from each individual work space to be channeled directly from each user into the air filtration system and avoid exhaled air flowing to adjacent workers at the workstation or throughout the room.

In other embodiments of the invention, an elevated air system may be positioned on a stand-alone elevated support, e.g. platform, column, pedestal, holder, and the like, near multiple persons using dining tables (such as restaurants), desks (such as schools), conference tables and the like. In such embodiments, the elevated support may optionally include attached dividers to isolate persons using the shared space into divided individual use areas. In the stand-alone or retrofit embodiments, the underlying table, desk or other surface need not be integrated with the elevated support and optional attached dividers, as the air filtration system may be elevated on such surfaces at approximate mouth height by placing the supporting structure on the pre-existing surface. In further embodiments, it may be desirable to position and support an elevated air filtration system on a floor (such as a lobby, theater, stadium, arena, and like rooms and facilities where multiple persons may be standing or seated) at one or more locations and at approximate mouth height of the persons within the shared floor spaces. In further embodiments, it may be desirable to attach the filtration system at mouth height in the shared space and centralized (as optimum and practical as possible) between expected positions of persons to a wall or ceiling with an extension rod, cable or similar coupling device that permits the air filtration system to be suspended at the mouth heights of the multiple persons.

In one embodiment of the invention, optional divider that connect to the elevated air filtration system may be of varying sizes and heights so as to not be limited to dividing work space or table space for seated persons, but could be provided to divide personal space of persons intending to stand, lie and/or sit within a floor space (e.g. a divider could be approximately as tall as standing person while the air filtration system is elevated at approximate mouth height between the divided persons and their individual, divided spaces).

In preferred embodiments of the invention, the elevated support or wall/ceiling attachment for elevating or suspending the filtration system is adjustable for adjusting the height and/or position of the air filtration system to an optimum position relative to persons mouths and exhaling of air.

In alternative embodiments of the invention, an filtration system may be integrated into furniture without being elevated above chest level or at the head levels of persons in the room with the furniture. For example, a conference table may include an integrated aperture or multiple apertures in which a filter system is supported so that exhaled air from persons around the table is drawn into and cleaned by the air filtration system while such system is unobtrusive and relatively hidden from such persons. In such embodiment the integration of the air filtration system into the furniture provides improved aesthetics over conventional air filters that might, for instance, simply sit or hang on a furniture surface.

An air filtration system in elevated and/or furniture-integrated embodiments may be electrically powered (wired) or battery powered (wireless).

In some embodiments of the invention, air quality sensors may be coupled to an air filtration system supported on or in a furniture structure to provide automatic control of the air filtration system. For example, levels of carbon dioxide (such as exhaled from users in the room), VOC, particulates, pathogens or other undesirable components of air may be monitored and the connected air filtration system undergoes an automatic operation speed increase or decrease based on whether the levels are above or below threshold levels that trigger a change in operation of the air filtration system.

DETAILED DESCRIPTION OF THE INVENTION

Figure 1:
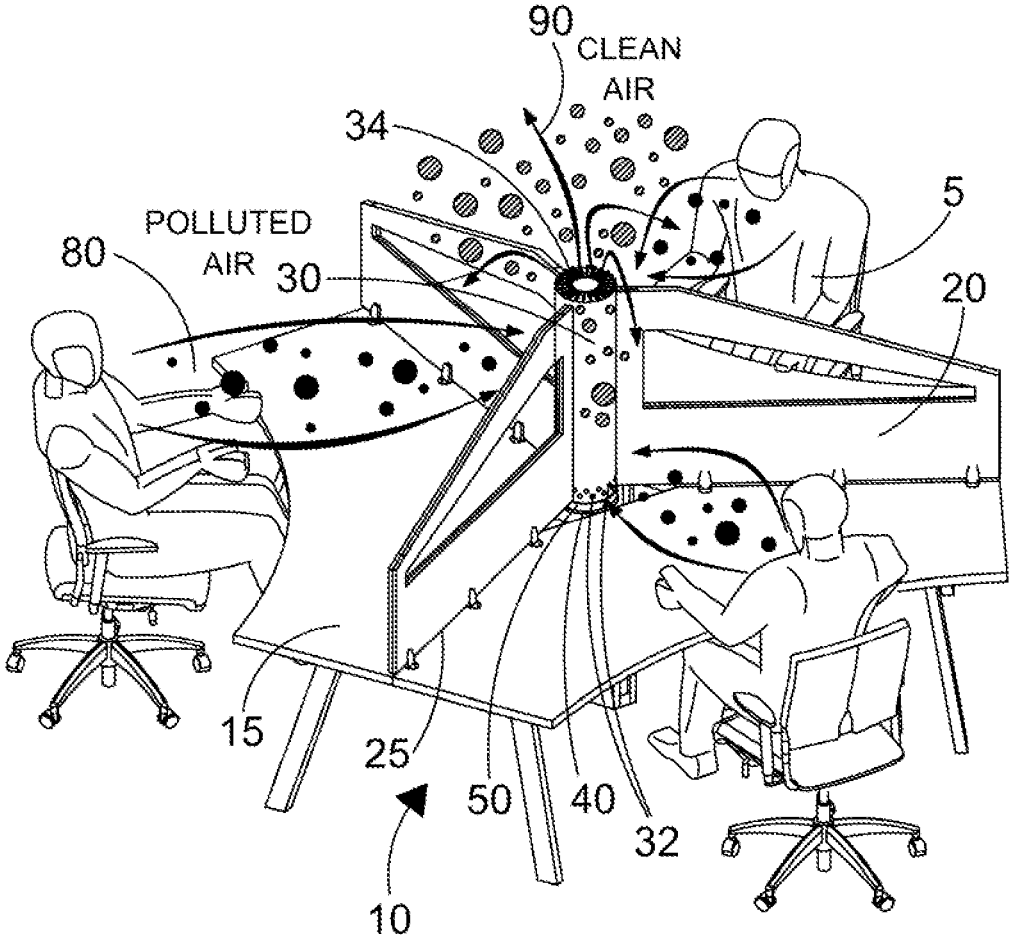
FIG. 1 is a schematic diagram of a furniture apparatus of a table including partitions divided into workspaces that includes an integrated air filtration system in one embodiment of the present invention.
Figure 2:
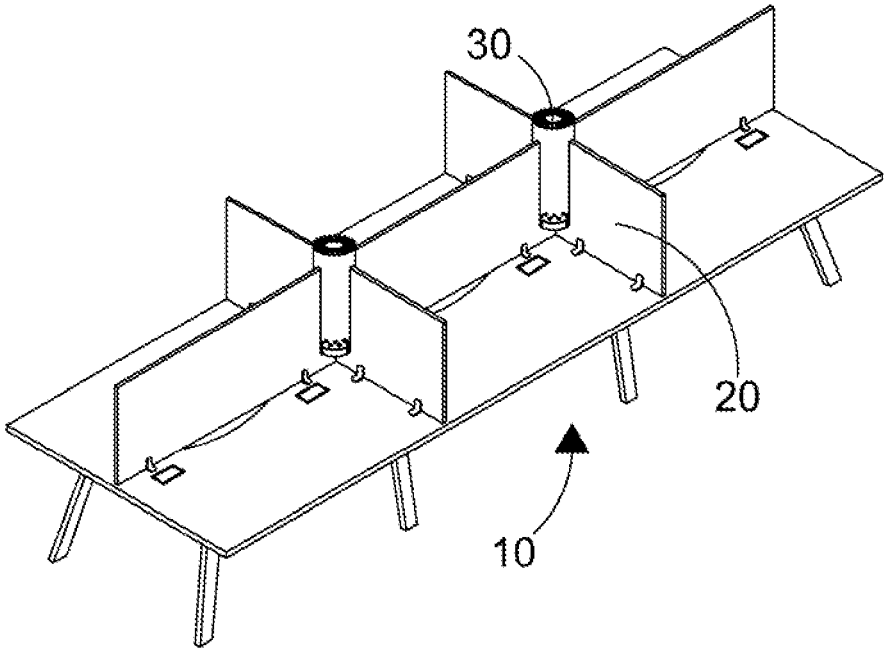
FIG. 2 is a perspective view from above of a furniture apparatus including partitions divided into workspaces that includes integrated air filtration systems in one embodiment of the present invention.
Figure 3:
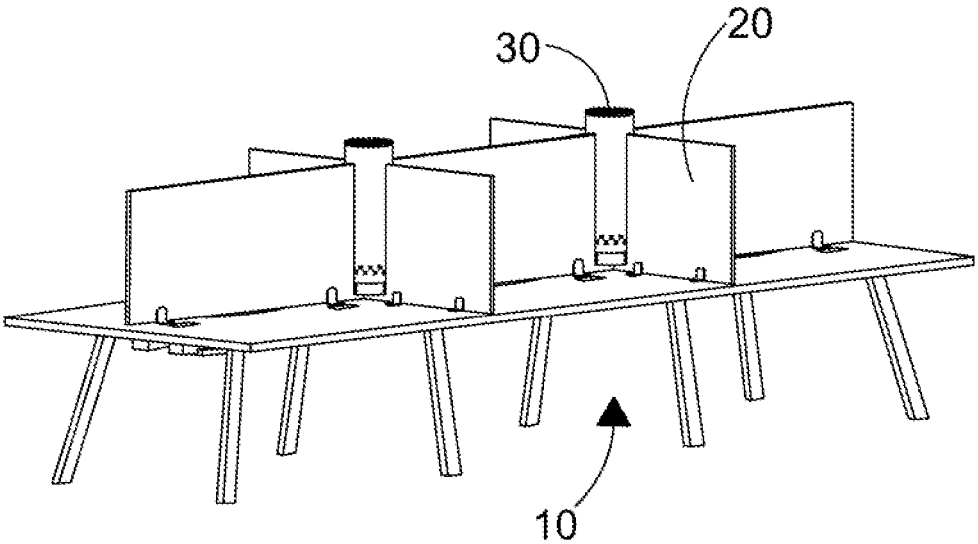
FIG. 3 is a front perspective view of a furniture apparatus including partitions divided into workspaces that includes integrated air filtration systems in one embodiment of the present invention.
Figure 4:
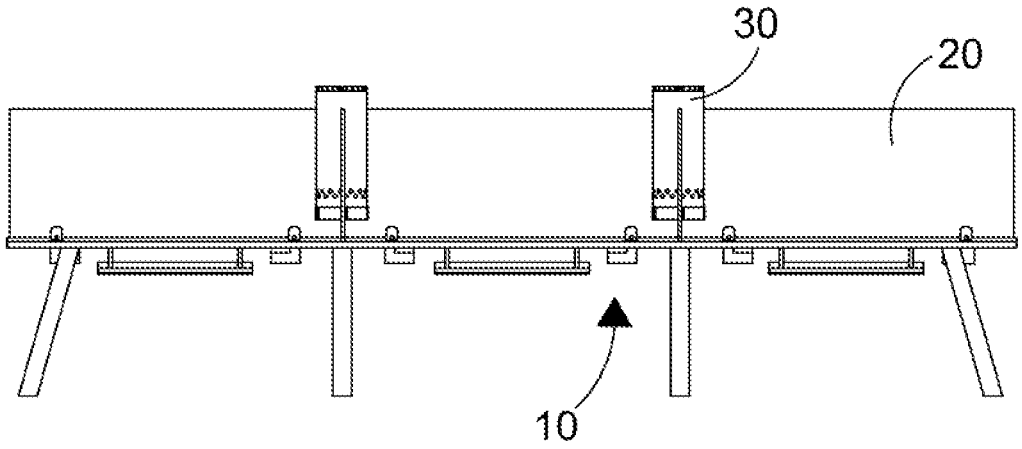
FIG. 4 is a front view of a furniture apparatus including partitions divided into workspaces that includes integrated air filtration systems in one embodiment of the present invention.
Figure 5:
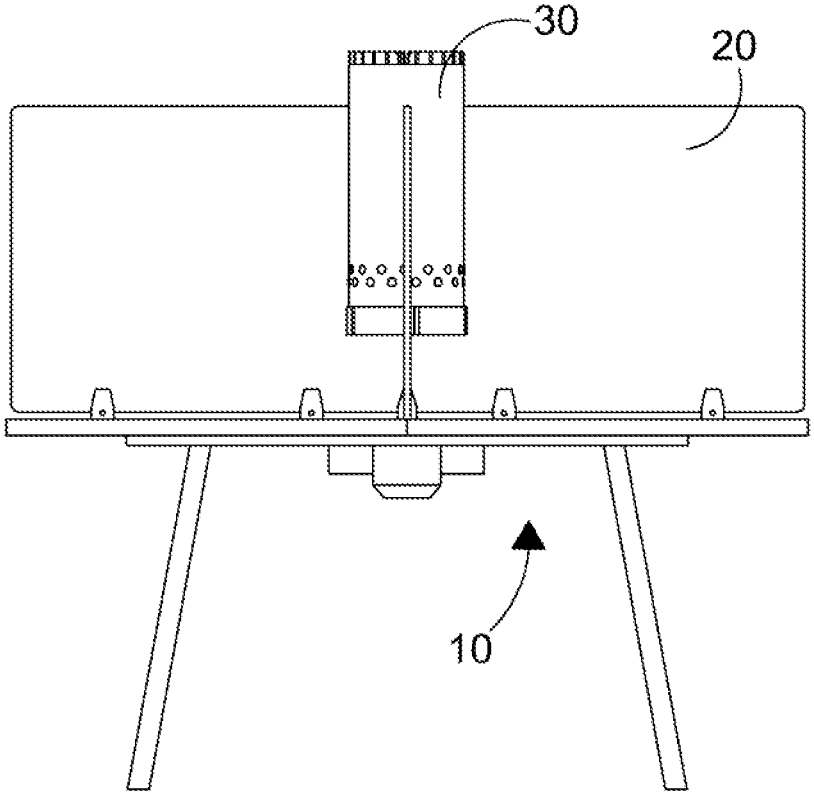
FIG. 5 is a side view of a furniture apparatus including partitions divided into workspaces that includes integrated air filtration systems in one embodiment of the present invention.
Figure 6:
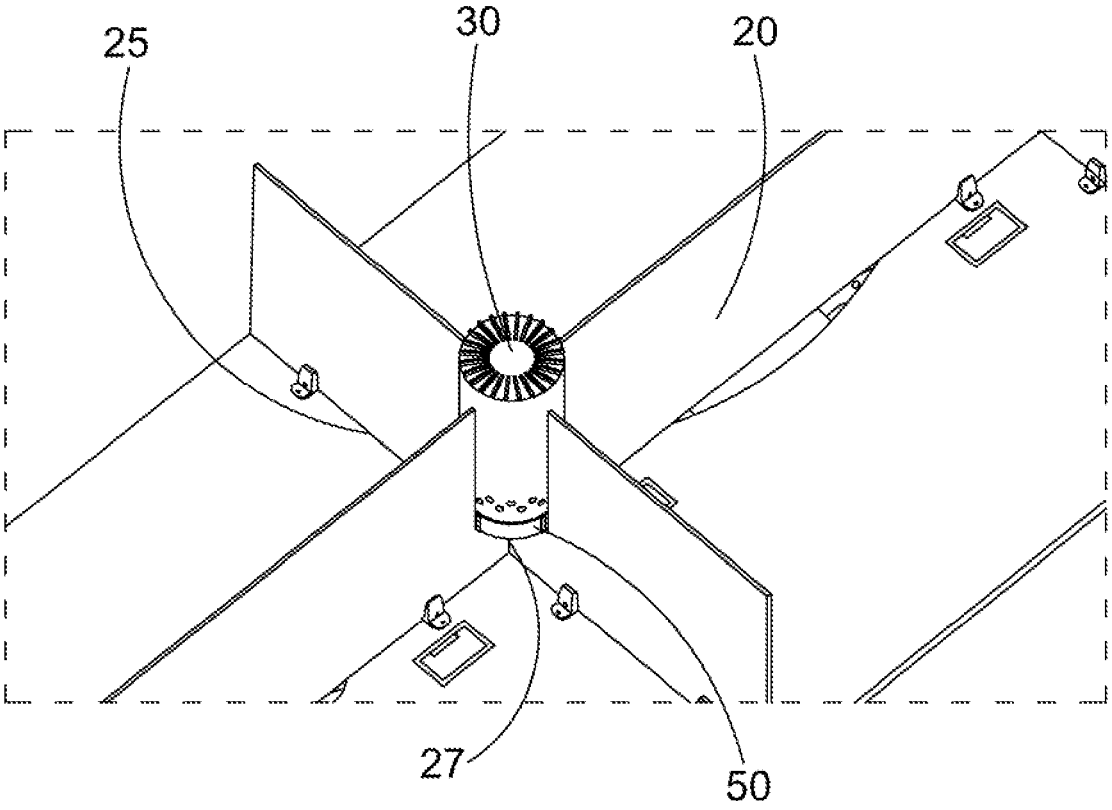
FIG. 6 is a top view of a furniture apparatus including partitions divided into workspaces that includes an integrated air filtration system in one embodiment of the present invention.

Referring to FIGS. 1-6, in embodiments of the invention a furniture apparatus 10 includes workstations with integrated holder 50 for supporting and securing one or more air filtration systems 30, preferably an electrically powered air purification system 30 available from Surgically Clean Air (but not limited to such air filter systems). In one embodiment an integrated holder base 40 supports integrated holder 50 in the furniture apparatus 10 and the air filtration system 30 is coupled and secured, such as by fasteners, adhesives, structural fit, and the like, to the integrated holder 50 in the furniture apparatus 10. Preferably in workstation embodiments, the furniture apparatus 10 includes partitions as dividers 20 that are preferably essentially air-sealed (such as where the partitions meet at the work surface 15 at seam 25 and meet at one another at seam 27 (FIG. 6) so that exhaled air 80 of individuals 5 in each respective divided workspace is directly channeled or funneled to the adjacent powered air filtration system 30 that is suctioning air into the system at air intake 32 and releasing clean air 90 out of the air filtration system at air outlet 34. Preferably the air filtration system(s) 30 are centrally located relative to the furniture apparatus 10 and the individuals 5 using the apparatus 10 to maximize filtering of exhaled air 80 in the respective area of a room. It will be appreciated that although air intake 32 may be illustrated in some embodiments as holes, screens or similar apertures and air outlet 34 may be illustrated as a louvered aperture at a top of the air filtration system 30, that such depicted structures are not intended to limit air intake and outlet structures that may be utilized in the invention so that each of an air intake 32 and air outlet 34 are open and in communication with ambient air adjacent the furniture apparatus 10 so that individuals 5 in close proximity to the furniture apparatus 10 are having polluted/exhaled air 80 filtered and returned as filtered air 90 nearby the furniture apparatus 10. Those of ordinary skill in the art will appreciate that numerous types of openings for intake(s) and outlet(s) may be provided to allow polluted air 80 into the air filtration system 30 and filtered air 90 out of the air filtration system with similar quality of operation of an air filtration system 30 integrated and supported in a furniture apparatus 10.

In embodiments of the invention, integrated holder 50 includes various holding mechanisms that are pre-determined locations in or on a furniture apparatus for supporting and securing an air filtration system 30. An integrated holder 50 may include a cutout in which air filtration system 30 is seated and secured, a bracket for an air filtration system 30, a shelf, ledge or flange that supports an air filtration system 30 on the furniture apparatus, a clamp, strap or clasp for securing an air filtration system 30 to the furniture apparatus 30, a seating support or recess of the furniture apparatus into which an air filtration system 30 is fitted, a hook coupling an air filtration system 30 to a furniture apparatus 10 and like holding mechanisms.

Depending on whether individuals 5 are adults or children and whether the furniture apparatus 10 is intended to be used in a seated or standing position, in embodiments of the invention it is preferable that the integrated air filtration system 30 is positioned and elevated at an optimum height position of where individuals 5 exhale air 80 from their mouths. In some embodiments of the invention, the air filtration system may be provided with a height-adjustable elevating support. The preferred height of the elevated air filters system is above the chests, and more preferably at head height, and most preferably at mouth height, of the persons using the workstations (typically when seated, but possibly at head/mouth heights to accommodate persons 5 working at that stations while standing). In one embodiment the integrated air filtration system 30 is at a height of above approximately three feet from the floor supporting the furniture apparatus 30. In another embodiment the integrated air filtration system 30 is at a height of above approximately four feet from the floor supporting the furniture apparatus 30. In a further embodiment the integrated air filtration system 30 is at a height of above approximately five feet from the floor supporting the furniture apparatus 30. In some embodiments where person 5 are anticipated to be seated near a surface of a furniture apparatus 10, an air filtration system 30 is integrated at a height above approximately one foot from the surface 15 of the furniture apparatus.

The workstations may be designed so that persons 5 at the workstation are at least 6 feet apart from one another and dividers are sufficiently sized so that a person cannot contact and exhaled air 80 avoids contacting persons 5 adjacent to that person and separated by the divider. It will be appreciated that exact dimensions and heights for elevation of the air filter systems will depend on the persons intended to use the same (such as potentially different dimension requirements for a child as compared to an adult). In preferred embodiments of the invention, the air filtration system 30 has a 360 degree opening for intake of the "dirty" exhaled air 80 that is being suctioned into the air filtration system 30 for filtering/purification and output of "clean" filtered air 90.

Figure 7:
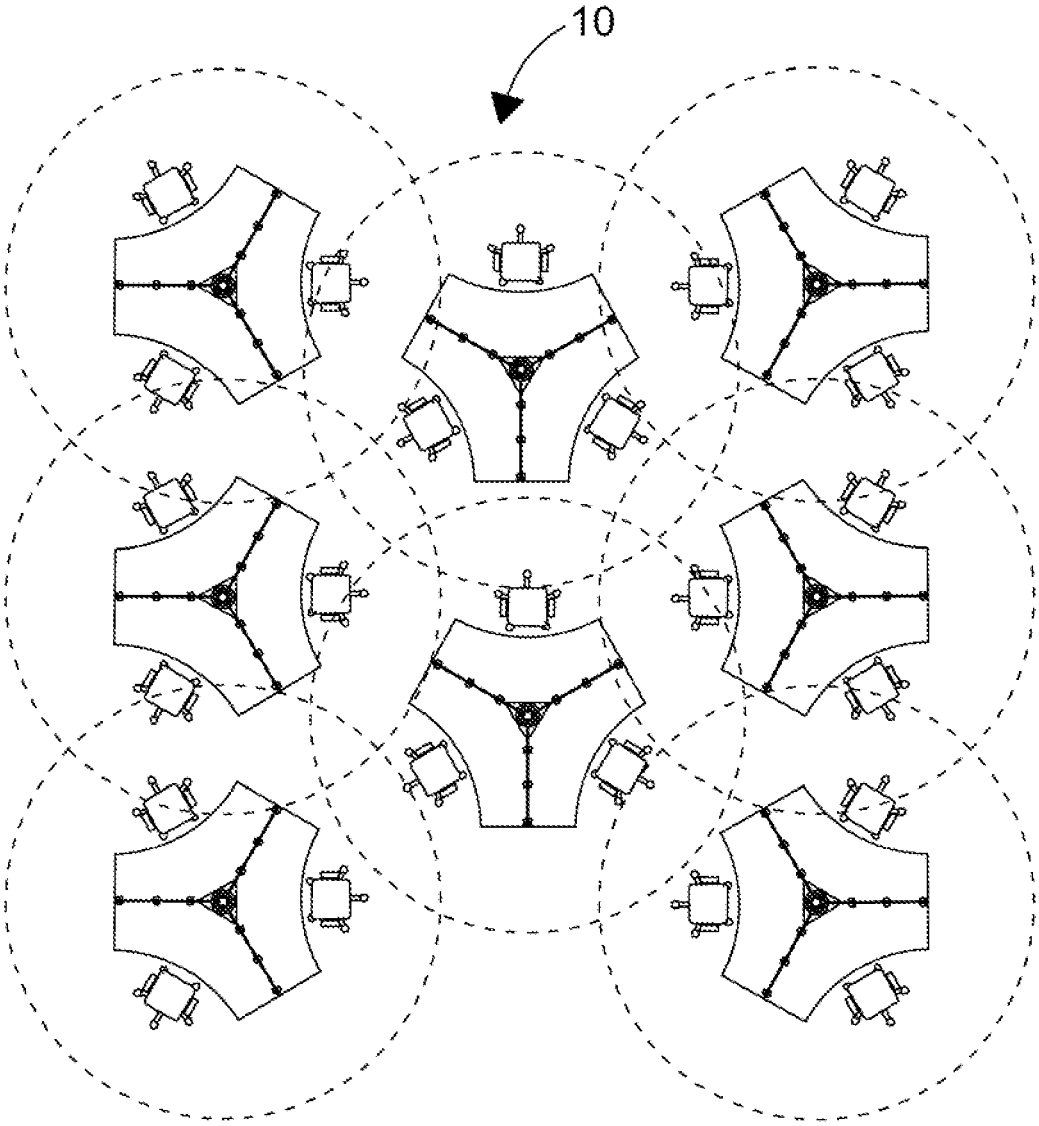
FIG. 7 is a schematic diagram of a multiple furniture apparatuses with integrated air filtration systems in a room depicting expected coverage of air being filtered in one embodiment of the present invention.

Referring to FIG. 7, a schematic diagram illustrates in one embodiment the expected filtration coverage in a room with a plurality of workstations including an integrated filter system 30 in each furniture apparatus 10.

Figure 8:
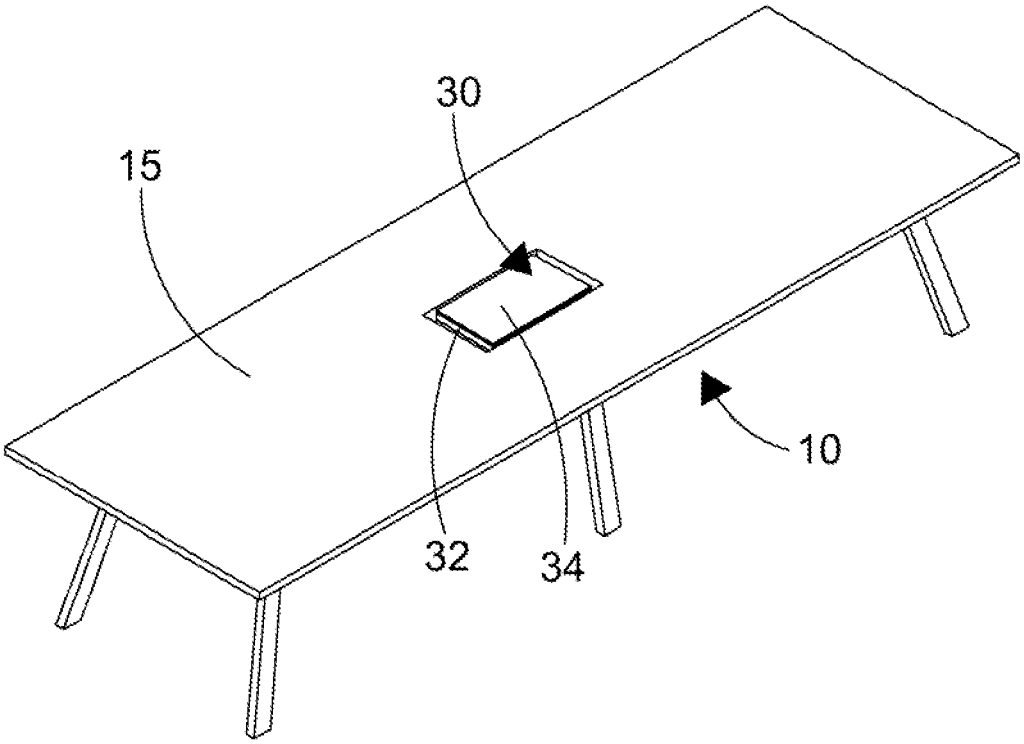
FIG. 8 is a front perspective view from above of an air filtration system integrated into a conference table in one embodiment of the present invention.
Figure 9:
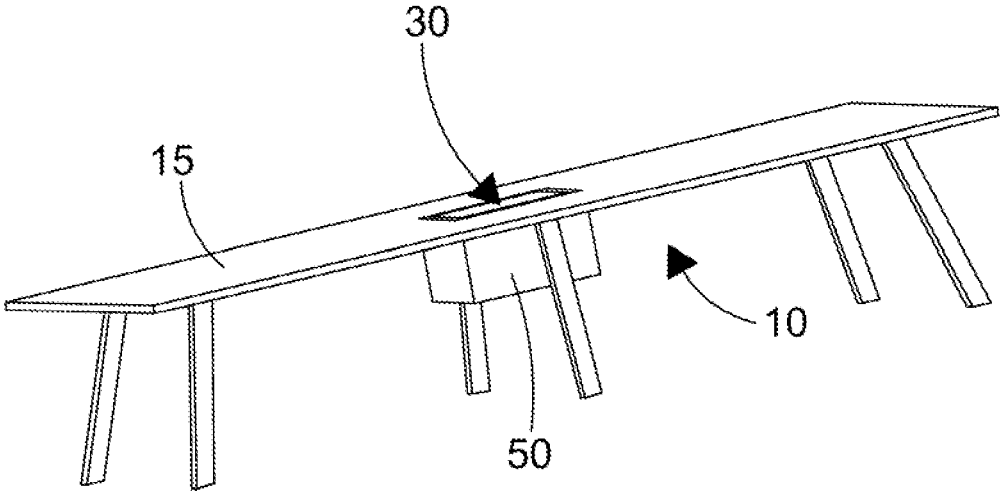
FIG. 9 is a front perspective view from below of an air filtration system integrated into a conference table in one embodiment of the present invention.
Figure 10:
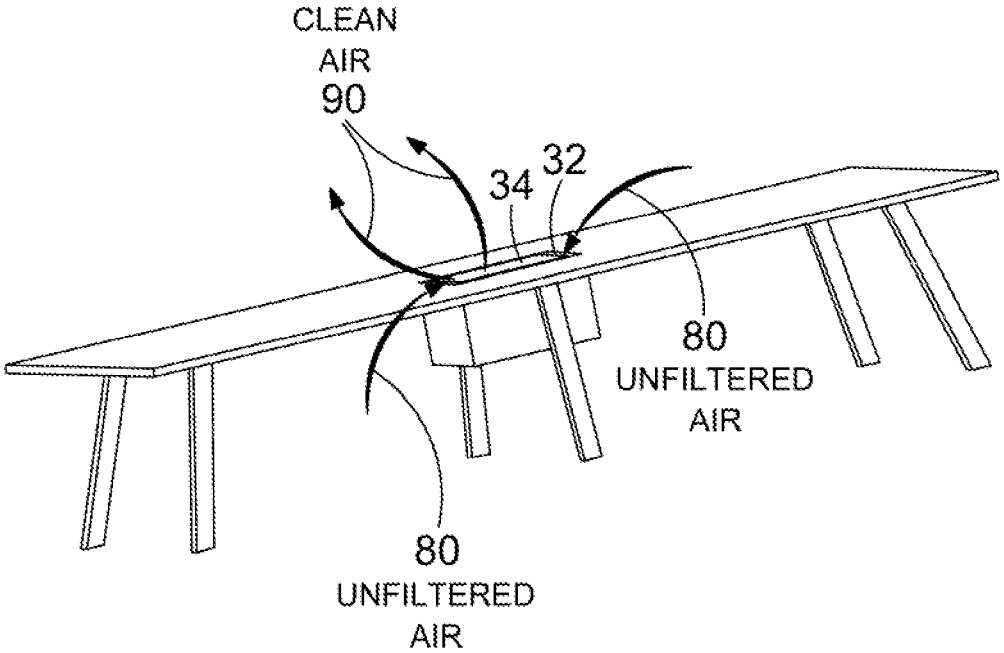
FIG. 10 is a front perspective view from below of an air filtration system integrated into a conference table and illustrating cleaning of ambient air in one embodiment of the present invention

Referring to FIGS. 8-10, in one embodiment of the invention an air filtration system 30 is integrated into a furniture apparatus 10 of a conference table. As shown, the air filtration system 30 may be recessed and coupled to an integrated holder 50 in the conference table in similar fashion to integration of audio speakers into furniture. In such embodiments the air outlet 34 face of the air filtration system 30 may be approximately flush with a surface of the conference table so as to minimize the appearance of the air filtration system 30. In such embodiments, air intake 32 is an opening or openings around the outer perimeter of the top of the air filtration system 30 that suctions in exhaled air 80 and clean air 90 is released from top face air outlet 34 within the air intake 32 perimeter.

Figure 11:
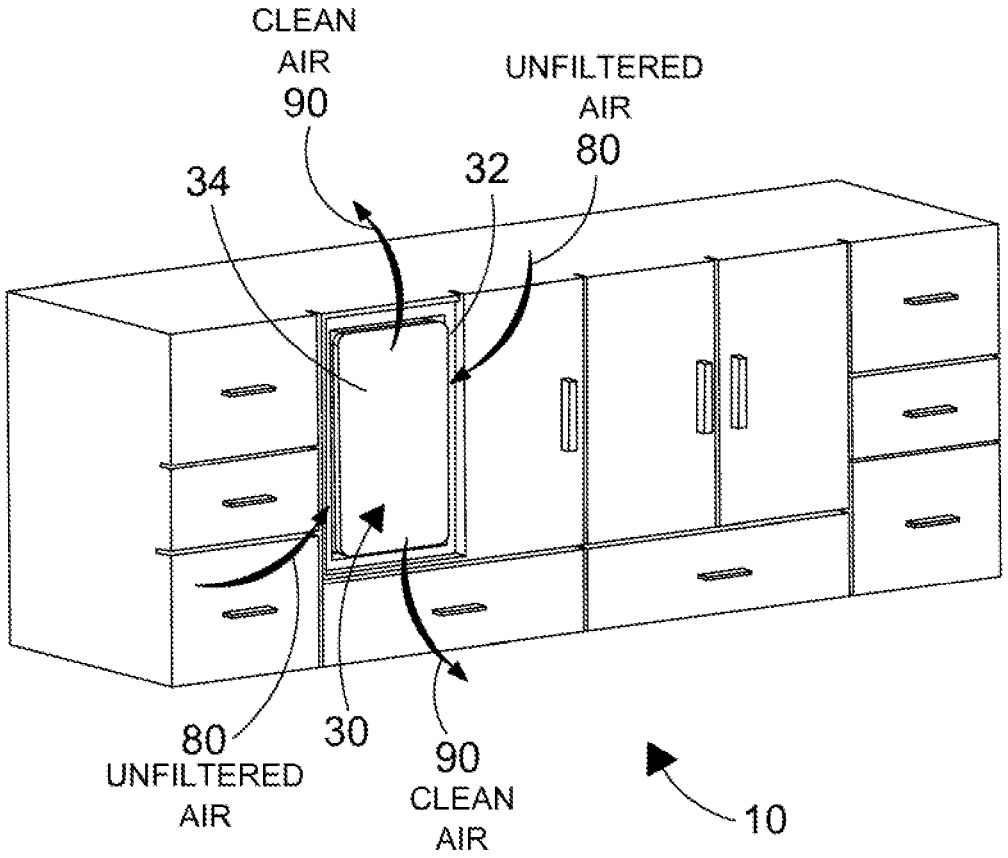
FIG. 11 is a front perspective view of an air filtration system integrated into a credenza and illustrating cleaning of ambient air in one embodiment of the present invention.

Referring to FIG. 11, and similar to the conference table embodiment shown in FIGS. 8-10, an air filtration system 30 is shown discretely integrated into furniture apparatus 10 of a credenza.

Figure 12:
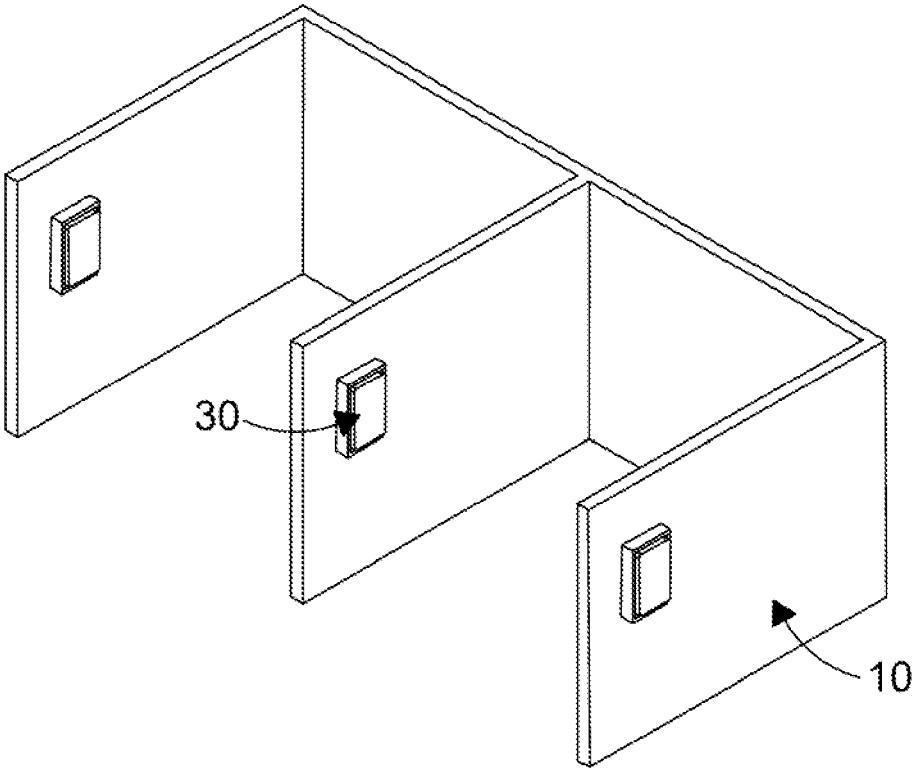
FIG. 12 is a side perspective view from above of an of air filtration systems integrated into cubicle partitions of cubicles in one embodiment of the present invention.
Figure 13:
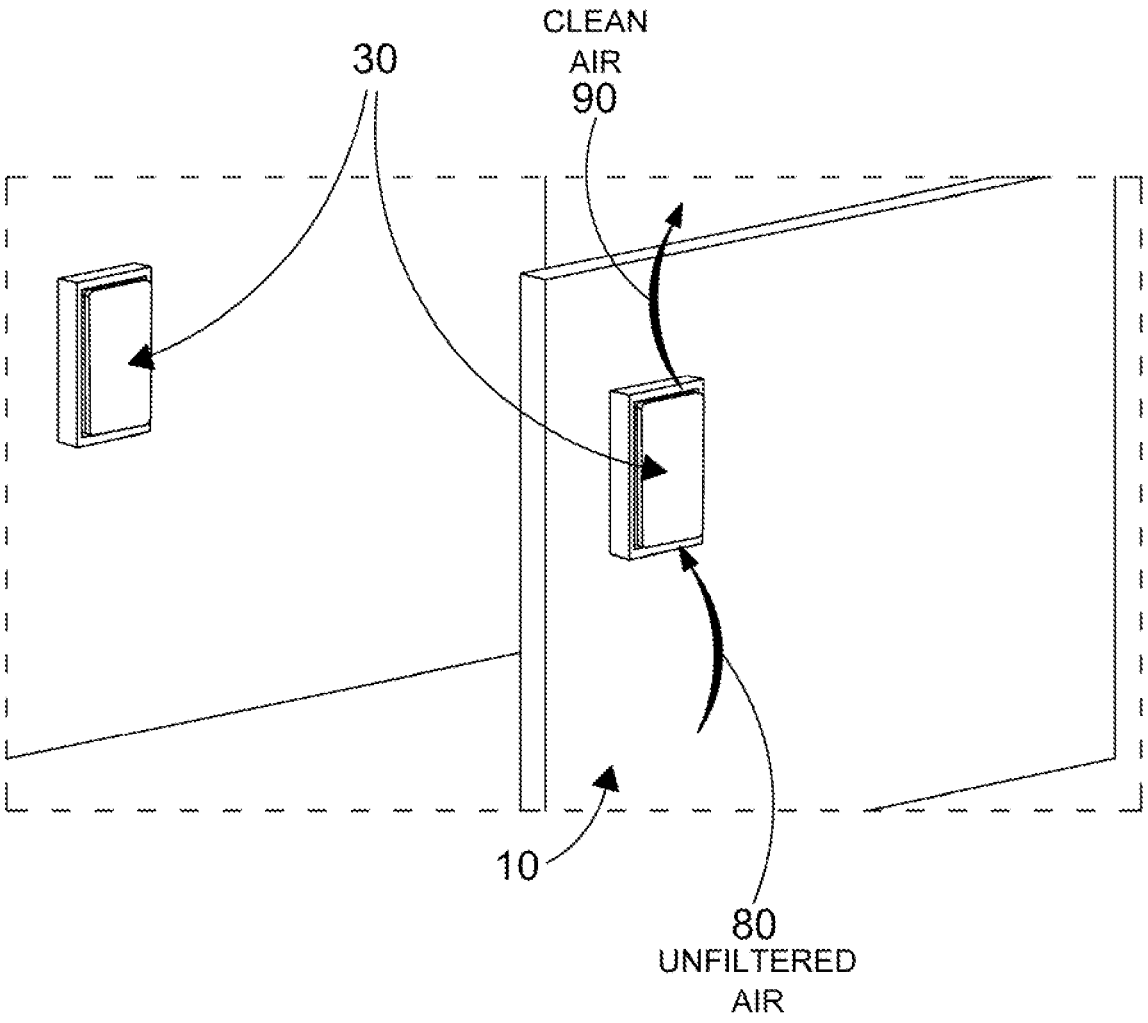
FIG. 13 is a side perspective view of air filtration systems integrated into cubicle partitions of cubicles and illustrating cleaning of ambient air in one embodiment of the present invention.
Figure 14:
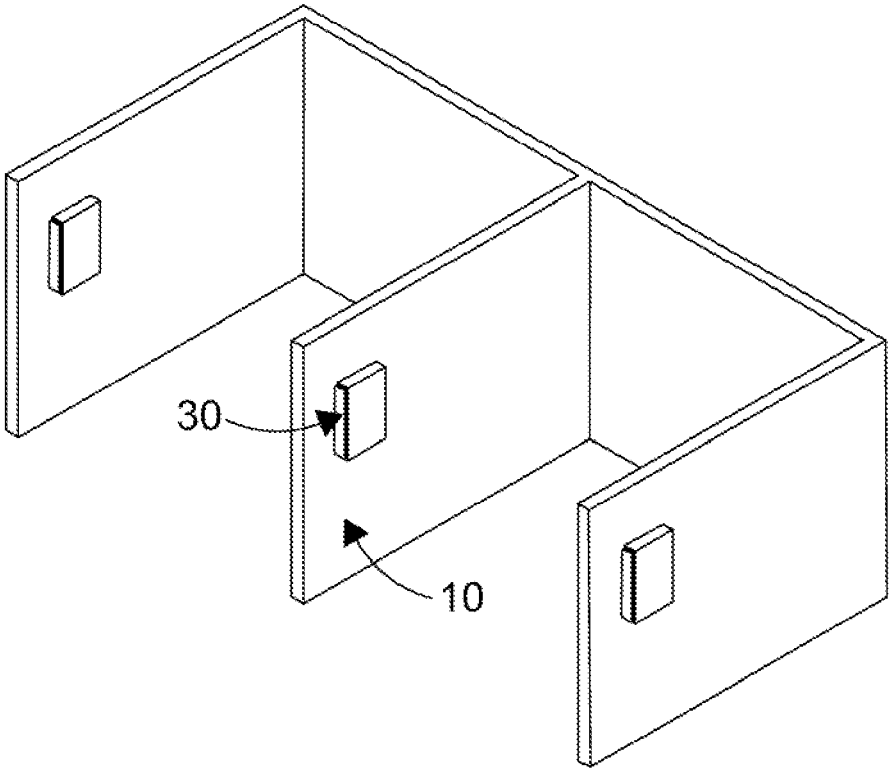
FIG. 14 is a side perspective view from above of air filtration systems integrated into opposite sides of cubicle partitions of cubicles in one embodiment of the present invention.
Figure 15:
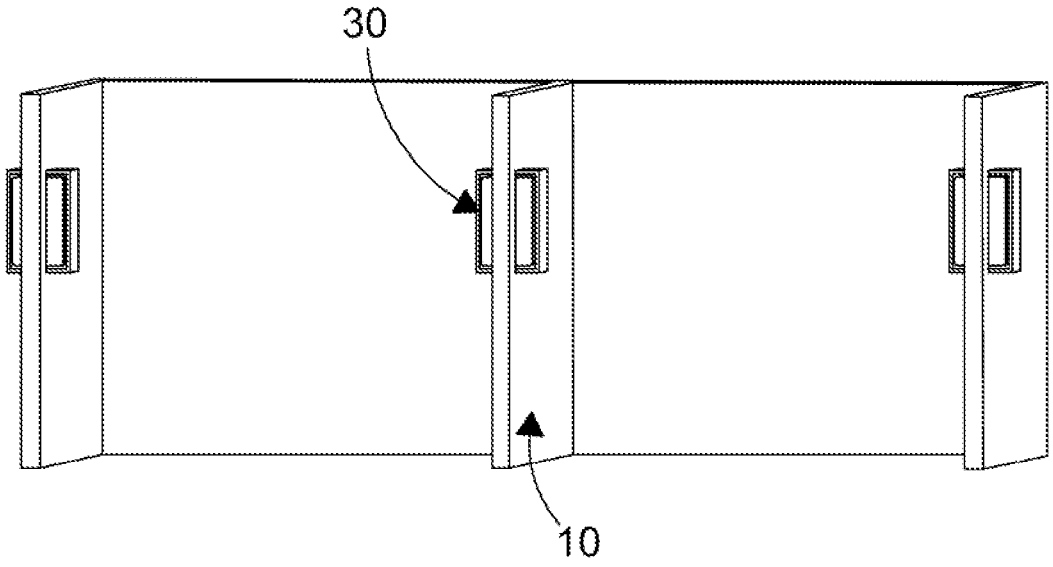
FIG. 15 is a front perspective view of air filtration systems integrated into opposite sides of cubicle partitions of cubicles in one embodiment of the present invention.
Figure 16:
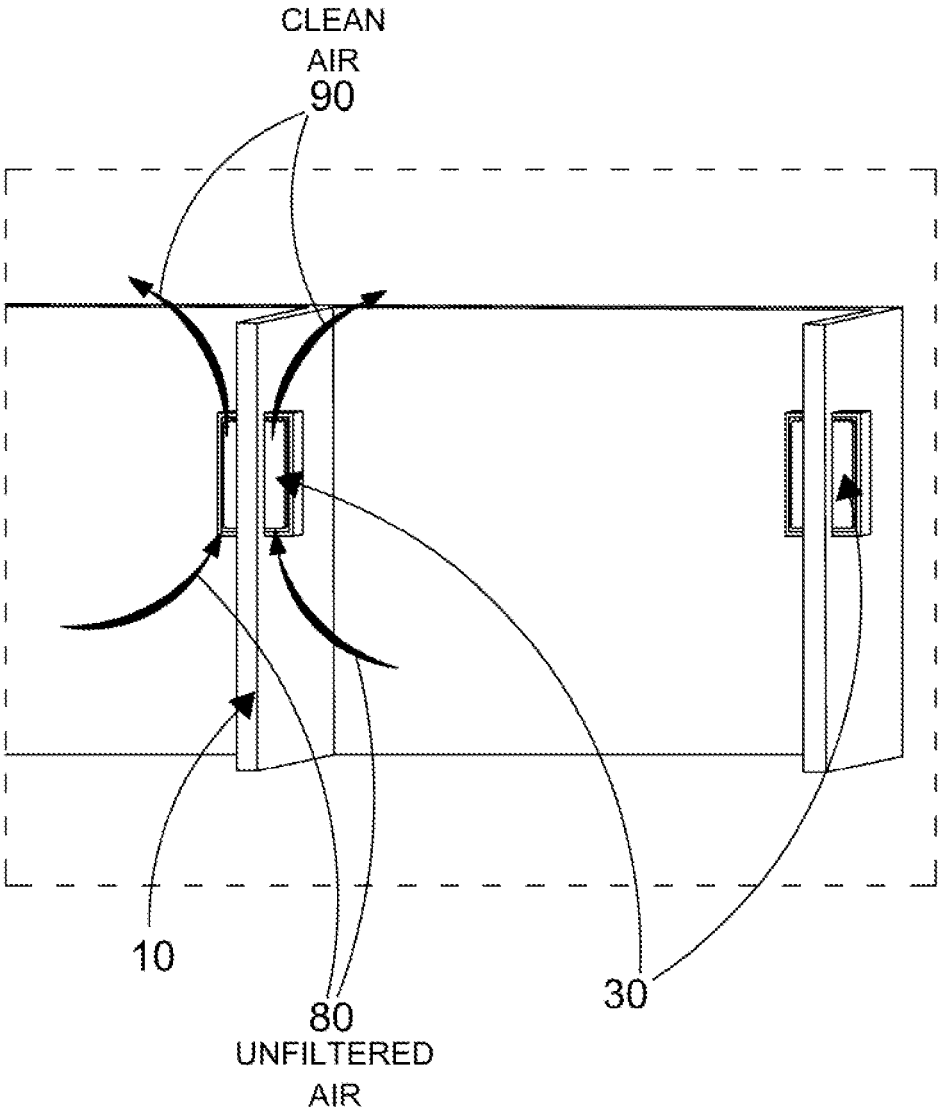
FIG. 16 is a front perspective view of air filtration systems integrated into opposite sides of cubicle partitions of cubicles and illustrating cleaning of ambient air in one embodiment of the present invention.

Referring to FIGS. 12-16, embodiments of air filtration systems 30 are shown integrated into a furniture apparatus 10 of cubicle partitions of cubicles. FIGS. 12 and 13 show one embodiment of a slim air filtration system 30 integrated in partitions, i.e. walls of cubicles, in which unfiltered ambient air 80 is suctioned into an air intake of the system 30 and filtered air 90 exits an air outlet of the system. In one embodiment in which air filtration systems 30 may be integrated into a single partition of each cubicle so that each cubicle has a respective single air filtration system 30. In other embodiments, such as shown in FIGS. 14-16, air filtration systems 30 may be provided in integrated holders 50 (not shown) of the cubicle partitions so that multiple air filtration systems 30 are matched to each cubicle. In some embodiments, such as shown in FIGS. 14-16, a larger air filtration system 30 may span through the entirety of a cubicle partition and held and secured in place across multiple cubicles so that unfiltered air 80 enters an air filtration system 30 on opposite sides of the partition and filtered air 90 is also provided on opposite sides of the partition. In the depicted embodiments of FIGS. 12-16, air intake 32 (not shown) may be provided a bottom side of air filtration system 30 and air outlet 34 may be provided at top side of the system 30. In other embodiments air intake 32 and out 34 may be provided on other sides (such as opposite front and back sides of system 30) or may be configured and operate like the air filtration systems 30 shown in FIGS. 8-11 for tables and credenzas where unfiltered air 80 enters intake 32 on the outer perimeter of air filtration system 30 and filtered air 90 exits a central outlet 34 within the perimeter of air filtration system 30.

Figure 17:
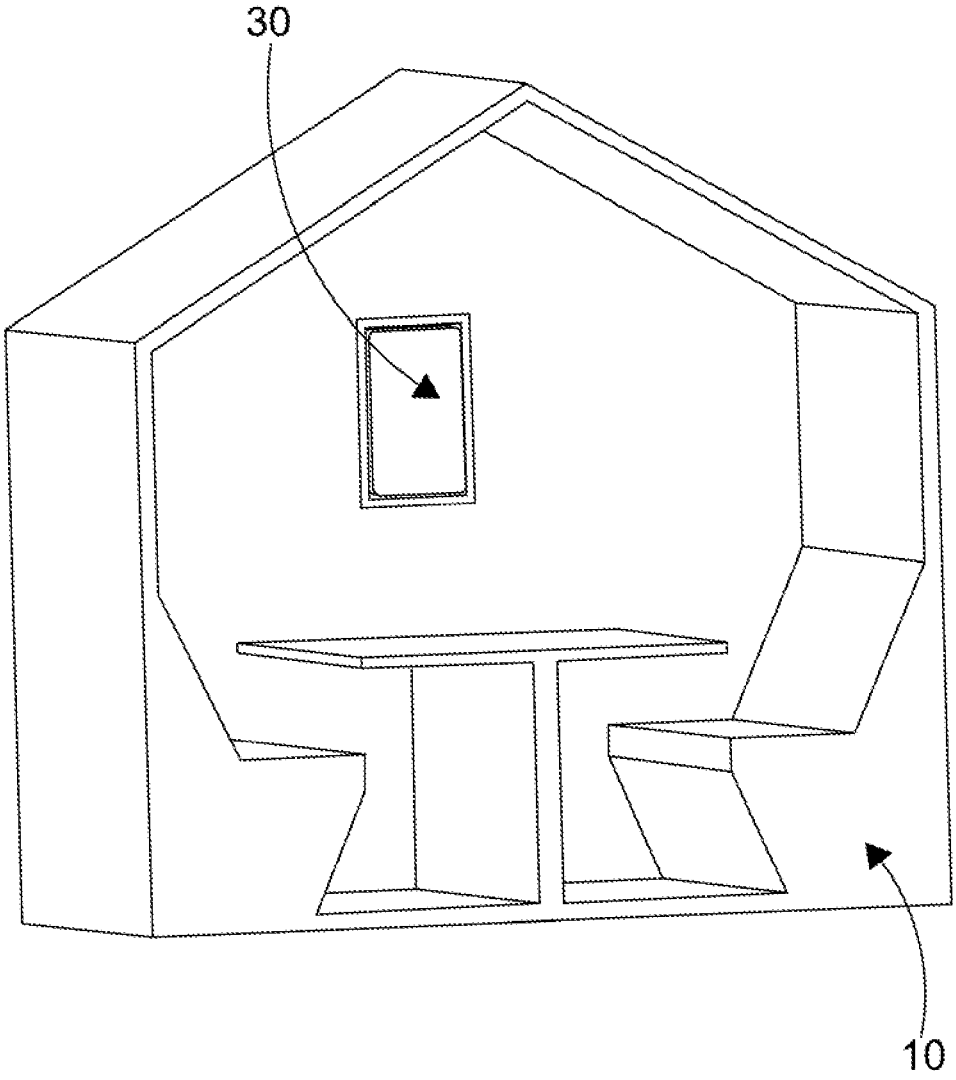
FIG. 17 is a front perspective view of a furniture apparatus of a booth-type pod including an integrated air filtration system in one embodiment of the present invention.

In other embodiments similar to the described cubicle and cubicle partition furniture apparatuses and as shown in FIG. 17, an air filtration system 30 may be integrated into the walls or inner surfaces of pods (including for example working, sleeping, transport and the like) and booths, such as a dining booth, phone booth, work booth and the like. An enclosed pod or booth may include a ceiling or roof-type structure intended to cover above the heads of users of the pod. It will be appreciated that in embodiments of an air filter system 30 integrated into a booth or pod that such furniture apparatus may be capable of being fully enclosed (such as by a door) or partially enclosed, such as open on one or more sides.

In various embodiments of the invention, furniture apparatus 10 with an integrated holder 50 coupled to an air filtration system 30 may include, for example, a desk, table, workstation, booth, enclosed pod, conference table, credenza, cubicle, cubicle partition, room divider, room partition, stand, pedestal, column, chair, bed, sofa and the like.

Figure 18:
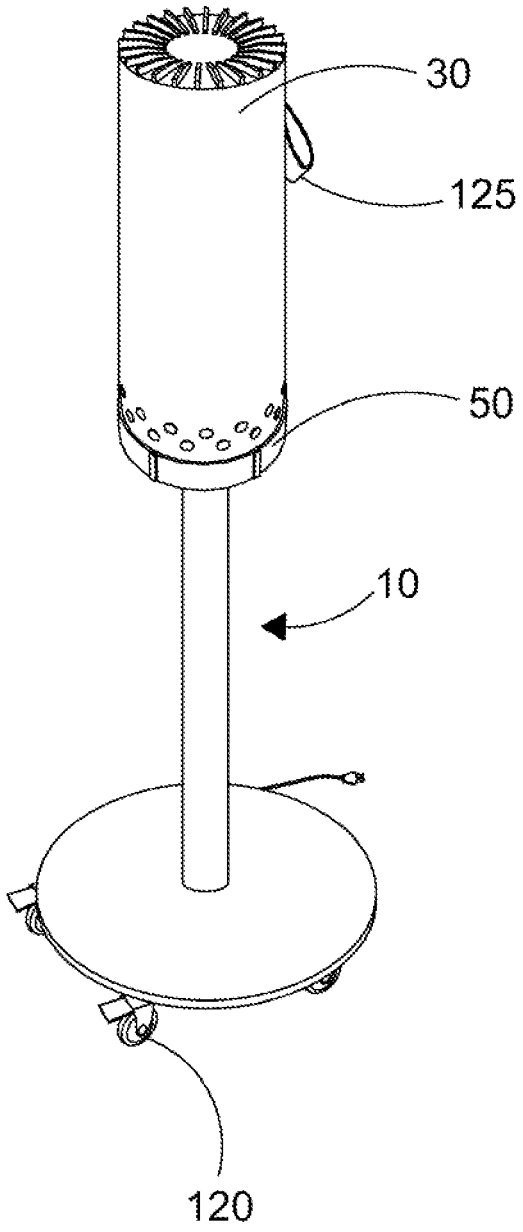
FIG. 18 is a front perspective view of a furniture apparatus of a mobile stand including wheels with an integrated air filtration system in one embodiment of the present invention.
Figure 19:
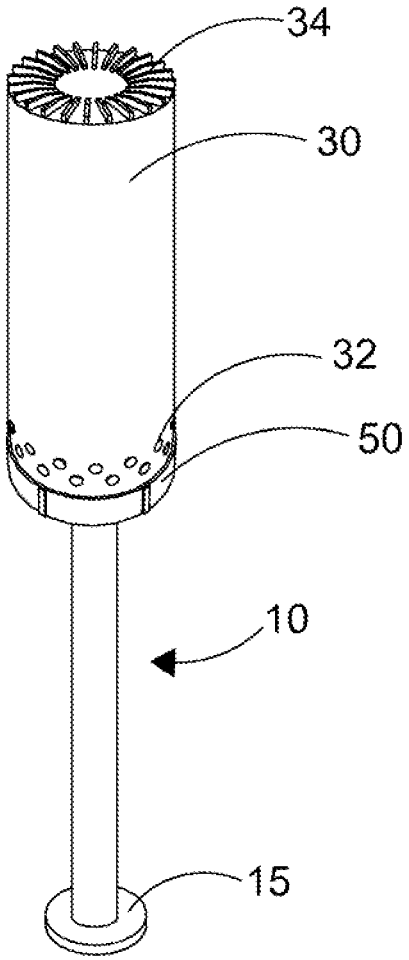
FIG. 19 is a front perspective view of a furniture apparatus of a stand with a pedestal-type base including an integrated air filtration system in one embodiment of the present invention.
Figure 20:
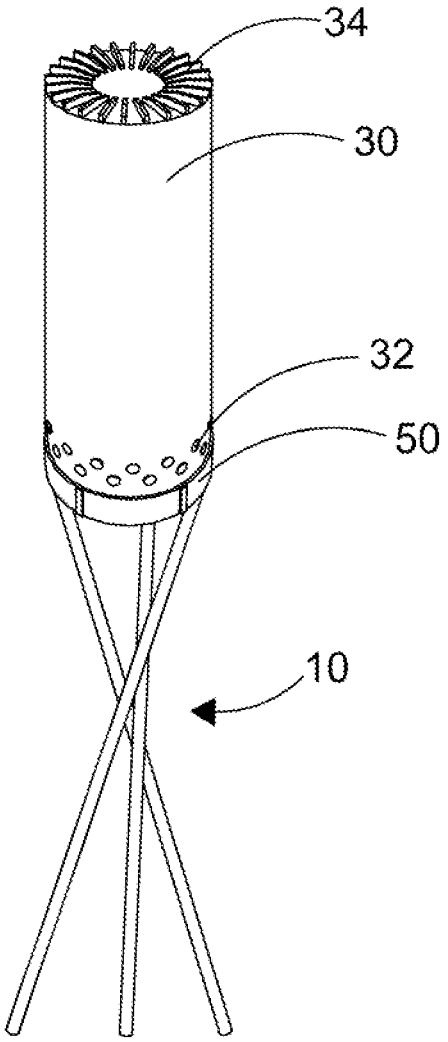
FIG. 20 is a front perspective view of a furniture apparatus of a stand with tripod-type supports including an integrated air filtration system in one embodiment of the present invention.
Figure 21A:
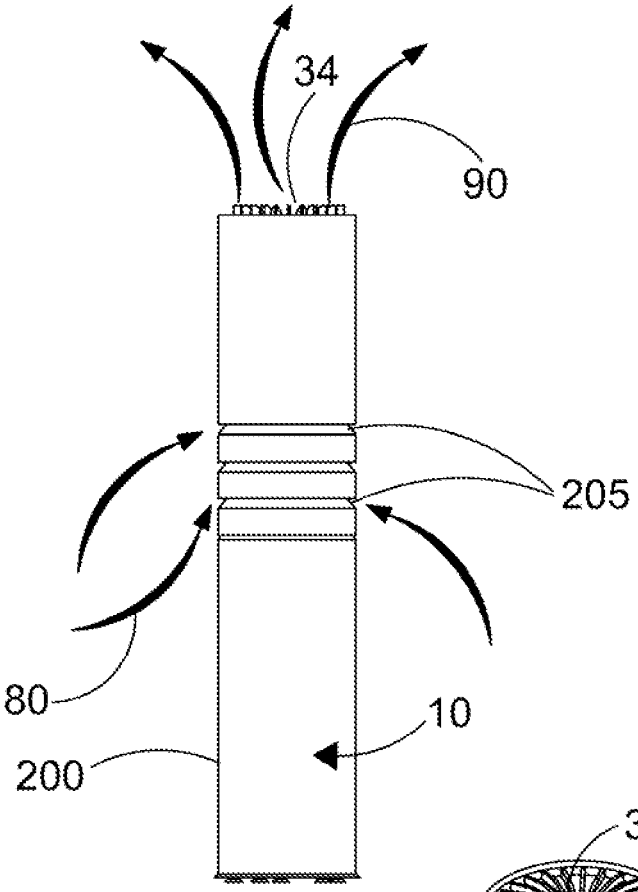
FIG. 21A is a front view of a furniture apparatus of a column stand with an outer casing having an air louvers set for air intake and including an integrated air filtration system in one embodiment of the present invention.
Figure 21B:
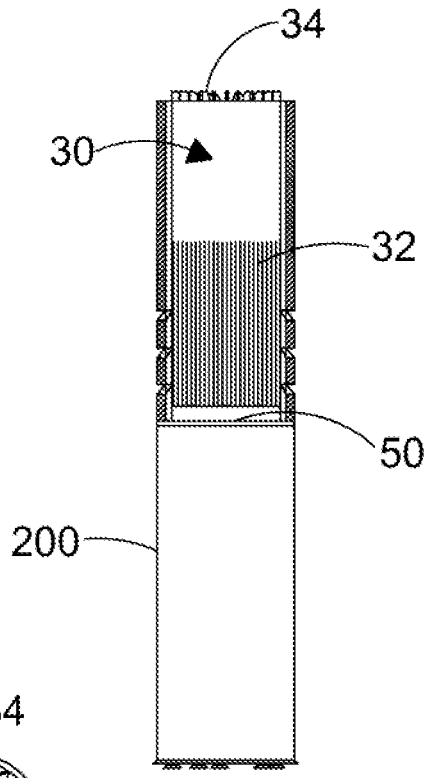
FIG. 21B is a front partial cutaway view of a furniture apparatus of FIG. 21A of a column stand with an outer casing and including an integrated air filtration system in one embodiment of the present invention.
Figure 21C:
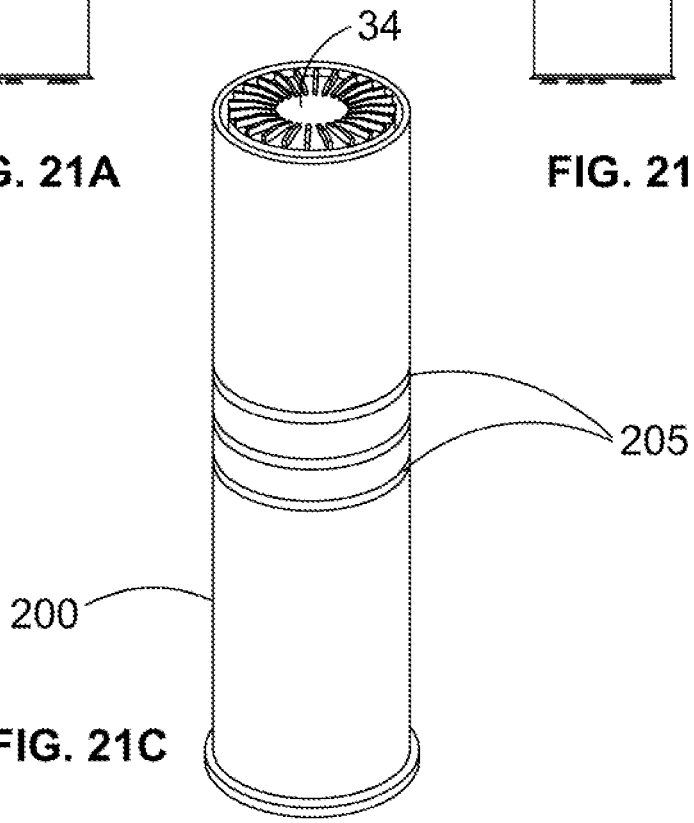
FIG. 21C is a front perspective view of a furniture apparatus of FIG. 21A of a column stand with an outer casing and including an integrated air filtration system in one embodiment of the present invention.
Figure 21D:
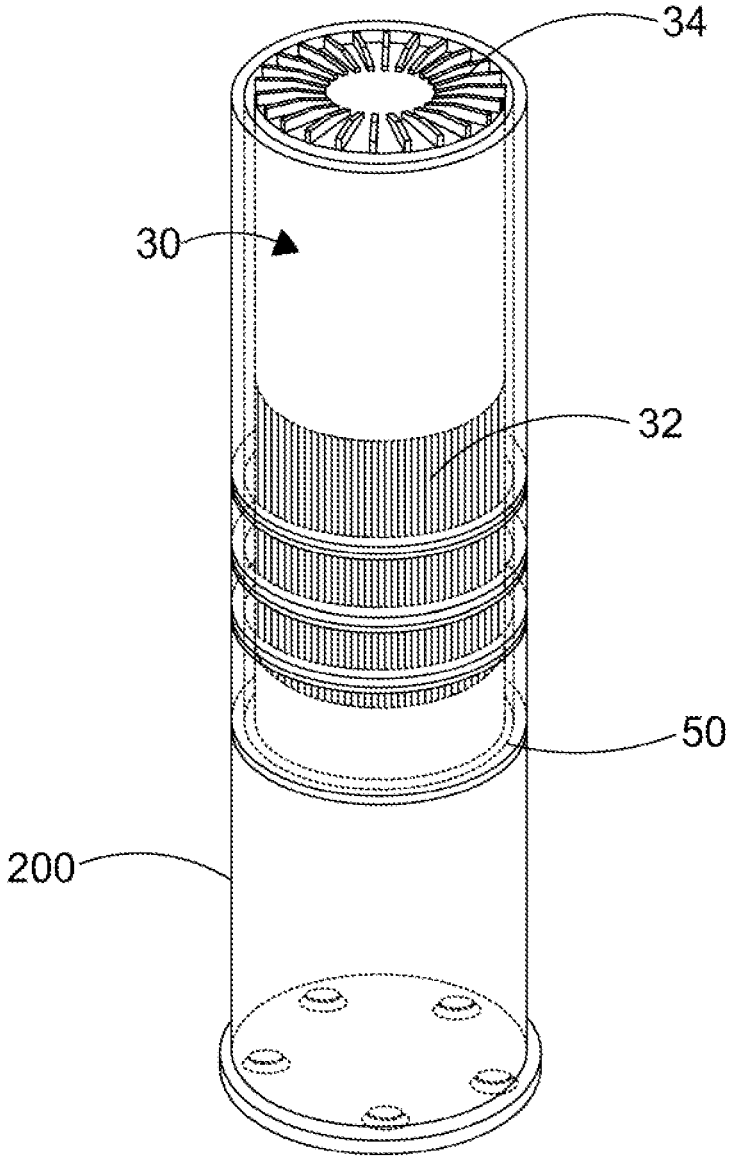
FIG. 21D is a front perspective sectional view of a furniture apparatus of FIG. 21A of a column stand with an outer casing and including an integrated air filtration system in one embodiment of the present invention.

Referring to FIGS. 18-20, in some embodiments a pedestal, column or similar elevating support is a furniture apparatus 10 provided to elevate a powered air filtration system 30 off of the floor and to a height preferably above the chests of persons in a shared space, more preferably at approximately head level of such persons, and most preferably at approximately mouth level of those persons. The elevation height of the air filtration system may be based on persons who are standing, sitting or lying on the floor (or on furniture that is on the floor). Multiple elevated air filtration systems may be placed throughout the room of a shared space to optimize airflow in intake and filtering of the exhaled air from multiple persons by the filtrations systems. In alternative embodiments (not shown), an air filtration system 30 or multiple air filtration systems 30 may be attached to a structure in a room, such as a wall or ceiling, and suspended or supported at a desired height relative to optimum position(s) where multiple persons are exhaling "dirty" air 80.

With further reference to FIG. 18, an elevated pedestal, column or support is coupled with an integrated holder 50 to an air filter system 30, such as by bolts, clips, adhesives, attachment hardware and the like, wherein the elevated filter system 30 is portable as including wheels 120, rollers and the like (including locking mechanisms for the wheels and rollers in some embodiments). It will be appreciated that wheels 120 and rollers coupled to an elevated filter system 30 provide portability to the system for more easily positioning and moving the filter system 30 across a floor and to desired locations in a room or other shared space for filtering exhalations 80 of persons in the room. Particularly in office or school environments the portable and elevated filter system 30 on a pedestal or column permits optimal positioning in the shared space for filtering air. In some embodiments, a power cord for the filter system may be hidden within the pedestal or column supporting the powered filter. In some embodiments, multiple portable and elevated filter systems may be placed throughout a room or similar shared space to filter exhalations with improved filtering coverage throughout the space.

In some embodiments of a portable and elevated filter system as shown in FIG. 17, a strap 125 or handle may be incorporated or coupled to the air filtration system 30 to make it easier to roll the furniture apparatus 10 to particular locations in a shared space. In further embodiments, the pedestal, stand and column embodiments for a furniture apparatus 10 may include a no-tip design to avoid unintended knocking over of the elevated filtration system 30.

With further reference to FIG. 19, in one embodiment a furniture apparatus 10 may integrate an air filtration system 30 on a column or pole-type support with a fixed pedestal base 15. The pedestal base 15 may be bolted or have a similar fixed coupling to the floor. The pedestal base 15 may also be heavily weighted so as to support the air filtration system 30 upright on the support pole or column. With reference to FIG. 20, in another embodiment illustrates that different furniture columns and pedestals can support an air filtration system 30 with different aesthetic effect, such as tripod supports.

Figure 24:
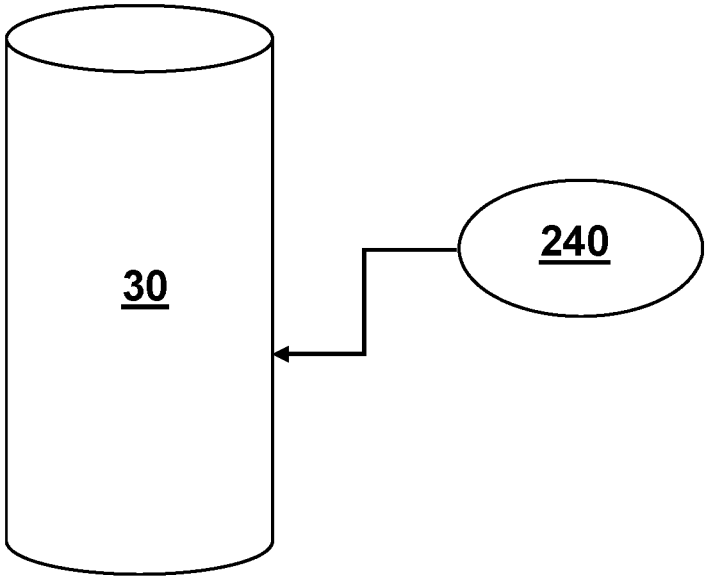
FIG. 24 is schematic block diagram of a filter system including an air quality sensor coupled to an air filtration system in one embodiment of the present invention.

In some embodiments of the invention, such as shown in FIG. 24, air temperature or air quality sensors 240 may be operatively coupled to an air filtration system 30 supported on or in a furniture apparatus 10 to provide automatic control of the air filtration system 30. For example, temperature level or levels of carbon dioxide (such as exhaled from users in the room), VOC, particulates, pathogens, pollutants or other undesirable components of air may be monitored and the connected air filtration system 30 undergoes an automatic on/off or operation speed increase or decrease based on whether the levels are above or below threshold levels that trigger a change in operation of the air filtration system 30. Those skilled in the relevant art will appreciate equipment and wired or wireless communication systems to couple an air quality sensor 240 to an air filtration system 30 for automatic operation of the air filtration system 30 integrated into furniture 10.

Referring to FIGS. 21A-21D and FIGS. 22A-22C, a furniture apparatus 10 may be decorative column or pedestal, such as free-standing on a floor or being supported on other furniture, shelves, and the like, with an integrated air filtration system 30 inside an outer casing 200. The outer casing 200 that internally houses the filtration system 30 supported by integrated holder 50 may be made of metal, wood, plastic and other aesthetically desired materials and in a wide variety of aesthetically desirable shapes, such as one dual-shaped design shown in FIG. 23. In the embodiment of FIGS. 21A-21D, the casing 200 includes a set of air intake louvers 205 so that polluted air 80 can be pulled into the casing and into the air intake 32 of the air filtration system 30 supported on integrated holder 50. After being filtered through the filtration system 30, filtered air 90 exits out of air outlet 34 at the top of the casing 200 of the embodiment of FIGS. 21A-21D and FIG. 23.

Figure 22A:
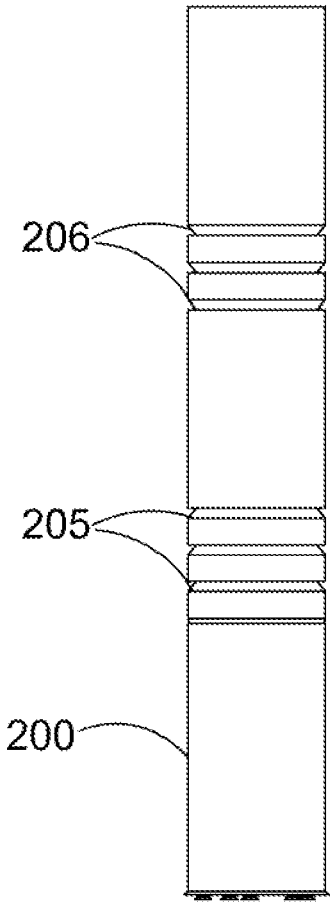
FIG. 22A is a front perspective view of a furniture apparatus of column stand with an outer casing having multiple air louver sets for both air intake and outlet that includes an integrated air filtration system in one embodiment of the present invention.
Figure 22B:
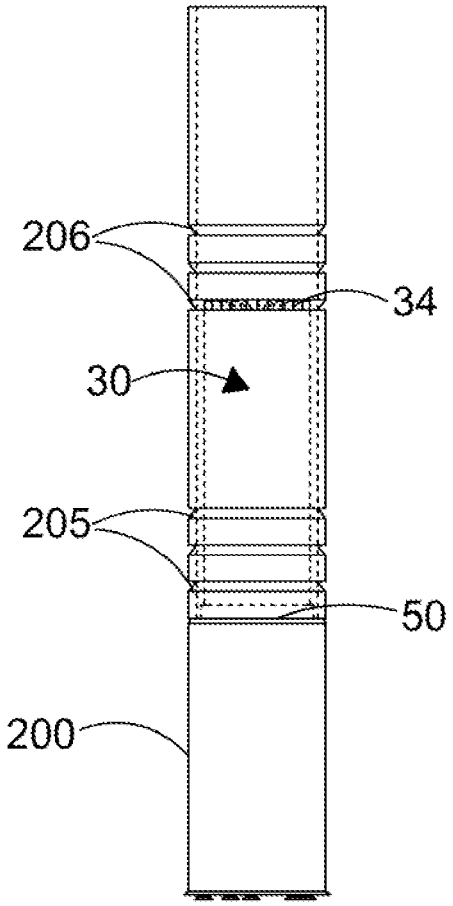
FIG. 22B is a front partial cutaway view of a furniture apparatus of FIG. 22A of a column stand with an outer casing and including an integrated air filtration system in one embodiment of the present invention.
Figure 22C:
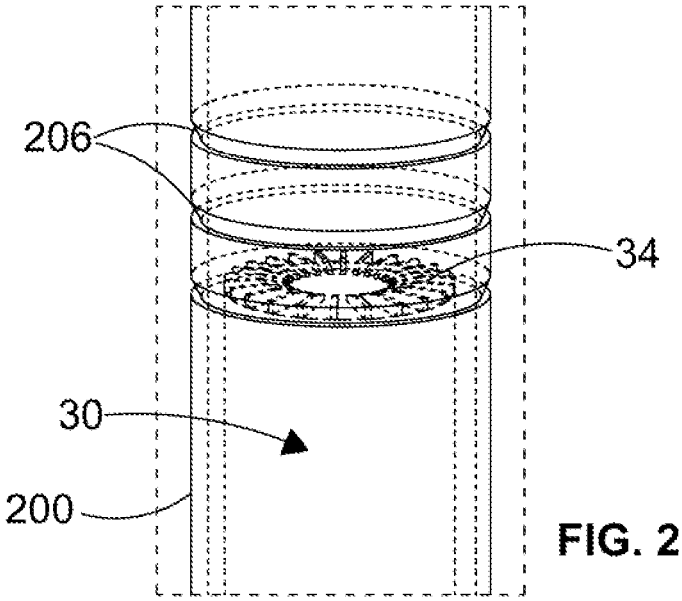
FIG. 22C is a front partial perspective and sectional view of a furniture apparatus of FIG. 22A of a column stand with an outer casing and including an integrated air filtration system in one embodiment of the present invention.
Figure 23:
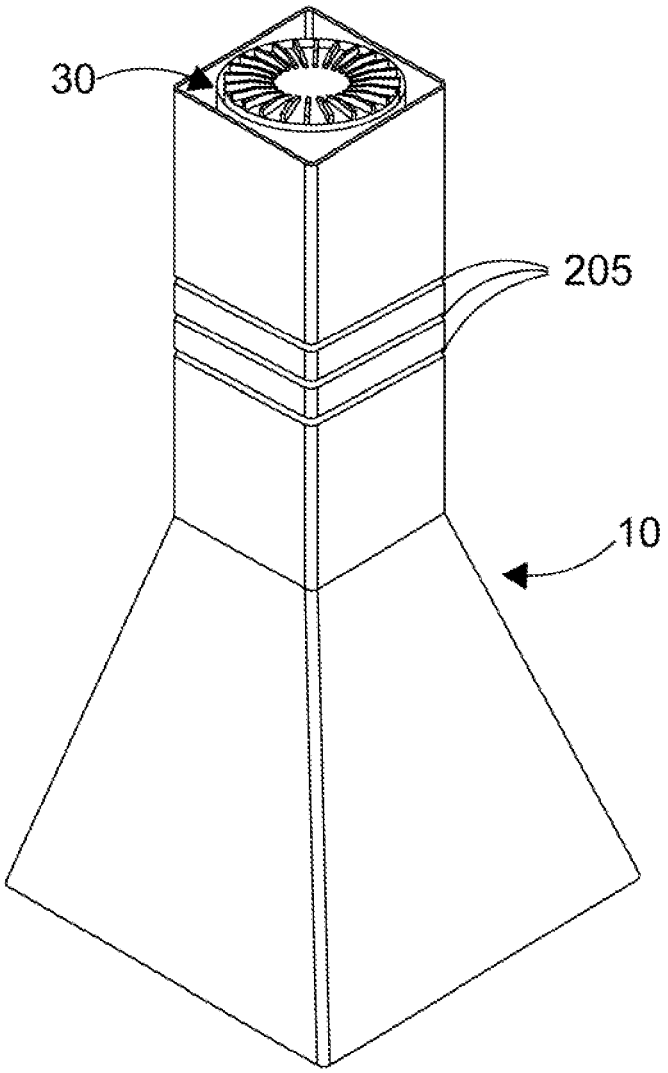
FIG. 23 is a front perspective view from above of a view of a furniture apparatus of a column stand with an outer casing having an expanded base and including an integrated air filtration system in one embodiment of the present invention.

In the embodiment of FIGS. 22A-22C, the casing 200 includes a set of air intake louvers 205 and also a set of air outlet louvers 206 so that polluted air 80 can be pulled into the casing and into the air intake 32 of the air filtration system 30 supported on integrated holder 50. After being filtered through the filtration system 30, filtered air 90 exits out of air outlet 34 that is internally near the air outlet louvers 206 so that filter air 90 can also exit the casing 200 and be returned to the ambient air. It this embodiment of FIGS. 22A-22C, the air filtration system 30 is more centrally supported on integrated holder 50 within the casing 200 as compared to the embodiment of FIG. 21A-21 D where casing air outlet louvers are not necessary when the air filtration system outlet 34 is at the top of the casing 200.

Various embodiments of the invention have been described. It will, however, be evident that various modifications and changes may be made thereto, and additional embodiments may be implemented, without departing from the broader scope of the invention as set forth by the claims. This specification is to be regarded in an illustrative rather than a restrictive sense.

What is claimed is:

1. A furniture apparatus comprising:

an integrated a holder retrofitted and coupled to a work, desk or table surface of the furniture apparatus, wherein the integrated holder supports and secures an electronic and self-contained air filtration system, wherein the air filtration system includes a top end, a bottom end and a vertical housing extending vertically between the bottom end and the top end;

having an air intake positioned including one or more openings around an external surface of the vertical housing and configured to communicate with ambient air 360 degrees around the external surface of the vertical housing; and air intake and air filtration system, and wherein the integrated holder elevates the air intake above the work, desk or table surface of the furniture apparatus, and wherein the air intake is positioned to suction air exhaled from one or more persons using the surface of the furniture apparatus free of an airflow barrier external to the air intake impeding suctioning of the air exhaled from the one or more persons into the air intake, and wherein the air filtration system further includes an air outlet positioned at the top end of the air filtration system above the air intake relative to the work, desk or table surface and the air filtration system is free of an external barrier impeding airflow between the air outlet and air intake;

multiple partitions that meet at a common seam beneath the holder, dividing the surface into multiple separated workspaces; and a HEPA filter positioned inside the self-contained air filtration system between the air intake and air outlet to capture and destroy at least one of a virus and a bacteria in the air exhaled from the one or more persons using the surface of the furniture apparatus into the ambient air adjacent the air intake.

2. The furniture apparatus of claim 1, wherein the holder is positioned to support the air intake higher than about three feet from a floor surface supporting the furniture apparatus.

3. The air filtration system of claim 2, wherein the holder is positioned to support the air intake higher than about four feet from the floor surface supporting the furniture apparatus.

4. The air filtration system of claim 3, wherein the holder is positioned to support the air intake higher than about five feet from the floor surface supporting the furniture apparatus.

5. The furniture apparatus of claim 1, wherein the multiple partitions provide surface seams with the surface of the furniture apparatus, and wherein the surface seams and the common seam are essentially air-sealed.

6. The furniture apparatus of claim 5, wherein the holder is configured to elevate the air filtration system higher than about a foot from the work, desk or table surface of the furniture apparatus.

7. The furniture apparatus of claim 5, wherein the holder is height-adjustable.

8. The furniture apparatus of claim 1, wherein the holder is height-adjustable.

9. The furniture apparatus of claim 1, wherein the air filtration system is coupled to an air quality sensor operably configured to automatically turn on or turn off the air filtration system based on air contaminant levels.

10. The furniture apparatus of claim 1, wherein the air filtration system is coupled to an air quality sensor configured to automatically adjust speed of the air filtration system based on air contaminant levels.

* * * * *